United States Patent [19]

Ozawa et al.

[11] Patent Number: 4,589,646

[45] Date of Patent: May 20, 1986

[54] AUTOMATIC PAPER FEEDING DEVICE FOR A PRINTER

[75] Inventors: Hideaki Ozawa; Seiji Hoshino; Yoshimitu Nagashima, all of Iruma, Japan

[73] Assignee: Silver Seiko Ltd., Japan

[21] Appl. No.: 672,663

[22] Filed: Nov. 19, 1984

[30] Foreign Application Priority Data

Nov. 25, 1983 [JP] Japan ..... 58-220566

[51] Int. Cl.[4] ..... B65H 5/06

[52] U.S. Cl. ..... 271/4; 271/10; 271/114

[58] Field of Search ..... 271/4, 10, 114, 115, 271/116; 400/624

[56] References Cited

U.S. PATENT DOCUMENTS 4,268,021 5/1981 Rutishauser ..... 271/116 X 4,509,734 4/1985 Rutishauser ..... 271/114 X 4,529,188 7/1985 Sturnick ..... 271/114 X

*Primary Examiner*—Richard A. Schacher

*Attorney, Agent, or Firm*—Lane and Aitken

[57] ABSTRACT

An automatic paper feeding device for a printer is disclosed which cyclically operates to automatically feed one after another of cut sheets of paper contained in a storage to a platen of the printer. A paper feed roller shaft is operatively connected to the platen, which is rotated by a motor, via a clutch mechanism including a clutch spring which is controlled by a controlling cam to intermittently and cyclically connect the shaft to a clutch sleeve connected to be rotated by the platen. Thus, after a paper sheet has been discharged from the printer after completion of printing, another paper sheet is automatically fed and positioned relative to the platen.

8 Claims, 6 Drawing Figures

AUTOMATIC PAPER FEEDING DEVICE FOR A PRINTER

BACKGROUND OF THE INVENTION

This invention relates to an automatic paper feeding device for a printer or a typewriter.

In a conventional automatic paper feeding device, a paper feed roller and a platen of a printer or typewriter are driven to rotate by individual motors. Accordingly, the conventional automatic paper feeding device has defects that a motor is required exclusively for a paper feed roller, and it is difficult to control both motors to operate in a synchronized relationship, the control system required for this device is complicated in construction, resulting in increase of troubles and of cost.

SUMMARY OF THE INVENTION

With the defects of the conventional automatic paper feeding device in view, the present invention provides an automatic paper feeding device wherein a paper feed roller shaft is rotated via a clutch by a platen which is rotated by a motor. After a paper feeding operation, rotation of the shaft is prevented during continued rotation of the platen by means of a clutch, thereby eliminating the necessity of provision of a motor exclusively for a paper feed roller, to eliminate the defects of the conventional automatic paper feeding device described above.

DETAILED DESCRIPTION OF THE INVENTION

Figure 1:
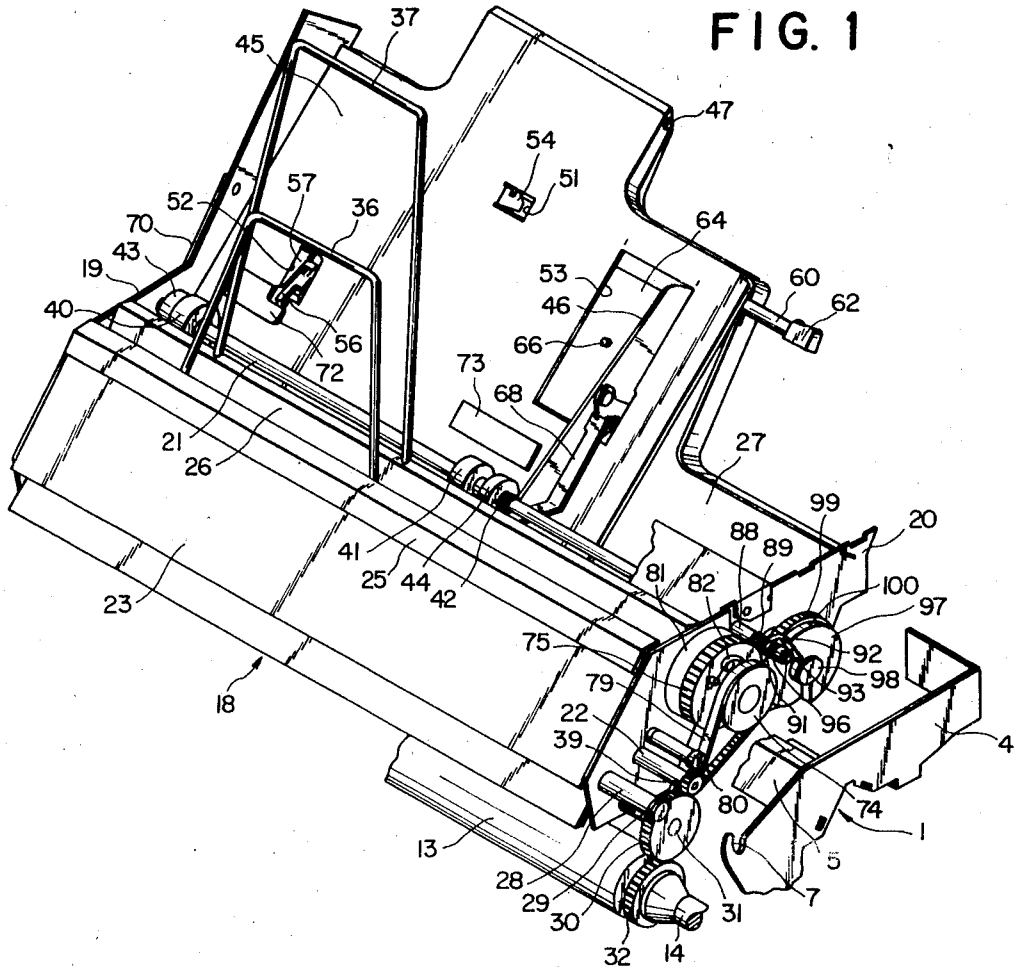
FIG. 1 is a perspective view, partly broken, showing an automatic paper feeding device embodying the present invention.

Now, description will be given of an embodiment illustrated in the accompanying drawings.

A mount 1 is removably mounted on a body 2 of a printer and includes a pair of left and right side walls 3 and 4 having a substantially L-shaped configuration and a paper guide plate 5 having a mountain-formed cross section and extending between the side walls 3 and 4.

Each of the left and right side walls 3 and 4 has a U-shaped holding recess 6 or 7 and a semicircular engaging portion 8 or 9 formed at a forward upper portion and a front lower portion thereof, and a hook 10 or 11 pivotally mounted at a portion adjacent thereto.

The mount 1 is removably mounted in position such that the left and right side walls 3 and 4 are supported on a support 12 mounted on the printer body 2 with the engaging portions 8 and 9 fitted in upper peripheral portions of annular grooves 15 and 16 formed around left and right portions of a shaft 14 for a platen or rotatable feeding element 13 of the printer and with the hooks 10 and 11 engaged with lower peripheral portions of the annular grooves 15 and 16, respectively.

The hooks 10 and 11 are each urged into such an engaging position by means of a spring 17 (the left-side one is omitted herein).

A base member 18 having a substantially rectangular configuration in plan is removably mounted on the mount 1 and has a pair of left and right side walls 19 and 20 between which a paper feed roller shaft 21, a delivery roller shaft 22, partition plates 23, 24, 25 and 26, a support plate 27, and a rod 28 are located.

The left and right side walls 19 and 20 have a flat central portion and a downwardly inclined forward portion, and the left side wall 19 has an upwardly inclined elongated rearward portion.

The partition plates 23 to 26, the delivery roller shaft 22 and the rod 28 are mounted on the forward portions and the paper feed roller shaft 22 is mounted on the central portions while the support plate 27 is mounted on rearward end portions of the left and right side walls 19 an 20.

Opposite ends of the rod 28 extends outwardly from the left and right side walls 19 and 20 and have each an annular groove 29 formed therearound.

A relay gear wheel 30 is mounted for rotation on a shaft 31 located on an outside face of the right side wall 20 below the rod 28.

When the base member 18 is placed on the mount 1 with rear end portions of the left and right side walls 19 and 20 thereof supported on rear end portions of the left and side walls 3 and 4 of the mount 1 and with the annular grooves 29 at left and right end portions of the rod 28 fitted with the holding recesses 6 and 7 of the left and right side walls 3 and 4, the relay gear wheel 30 is meshed with a platen gear wheel 32 fitted on the shaft 14.

The partition plates 23 to 26 are inclined forwardly downwardly and are spaced a predetermined distance from each other. A discharging path 33 for discharging paper after printing is defined between a lower portion of the partition plate 23 and the partition plate 24 while an insertion path 34 for manually inserting paper is defined between the partition plates 25 and 26.

A lower portion of the partition plate 25 is bent substantially in an L-shaped configuration to provide thereupon a receiving section or station 35 for receiving paper after printing thereon, and support rods 36 and 37 in the form of an arch for supporting paper received on the receiving section 35 are mounted at upper portions of the partition plates 23 and 25, respectively.

The support plate 27 has a mountain-like configuration and is inclined forwardly and downwardly. Most of the upper half of the support plate 27 extends above the right side wall 20.

The delivery roller shaft 22 has lower delivery or feed rollers 38 fitted at a central and opposite left and right portions thereof and has a gear wheel 39 fitted at a right end portion thereof which extends outwardly of the right side wall 20. The gear wheel 39 is in meshed engagement with the relay gear wheel 30.

The paper feed roller 21 has paper feed rollers 40 and 41 fitted thereon and has a right end portion extending outwardly of the right side wall 20.

The paper feed rollers 40 and 41 have collars 43 and 44 formed integrally therewith, respectively. The collars 43 and 44 have annular grooves 42 formed therearound. The paper feed rollers 40 and 41 have known one-way clutches (not shown) provided therein so that they can move in an axial direction of the paper feed roller shaft 21 and are rotated in integral relationship by rotation of the paper feed roller shaft 21 (in a clockwise direction in FIG. 3) whereas they can be rotated (in the clockwise direction in FIG. 3) when the paper feed roller shaft 21 is in a stationary position.

The paper feed roller 40 is located at a portion adjacent a left end of the paper feed roller shaft 21 while the paper feed roller 41 is linked with a paper holder 46 of a paper tray or supply station 45 so that it may be moved leftwardly and rightwardly together with the paper holder 46.

Figure 2:
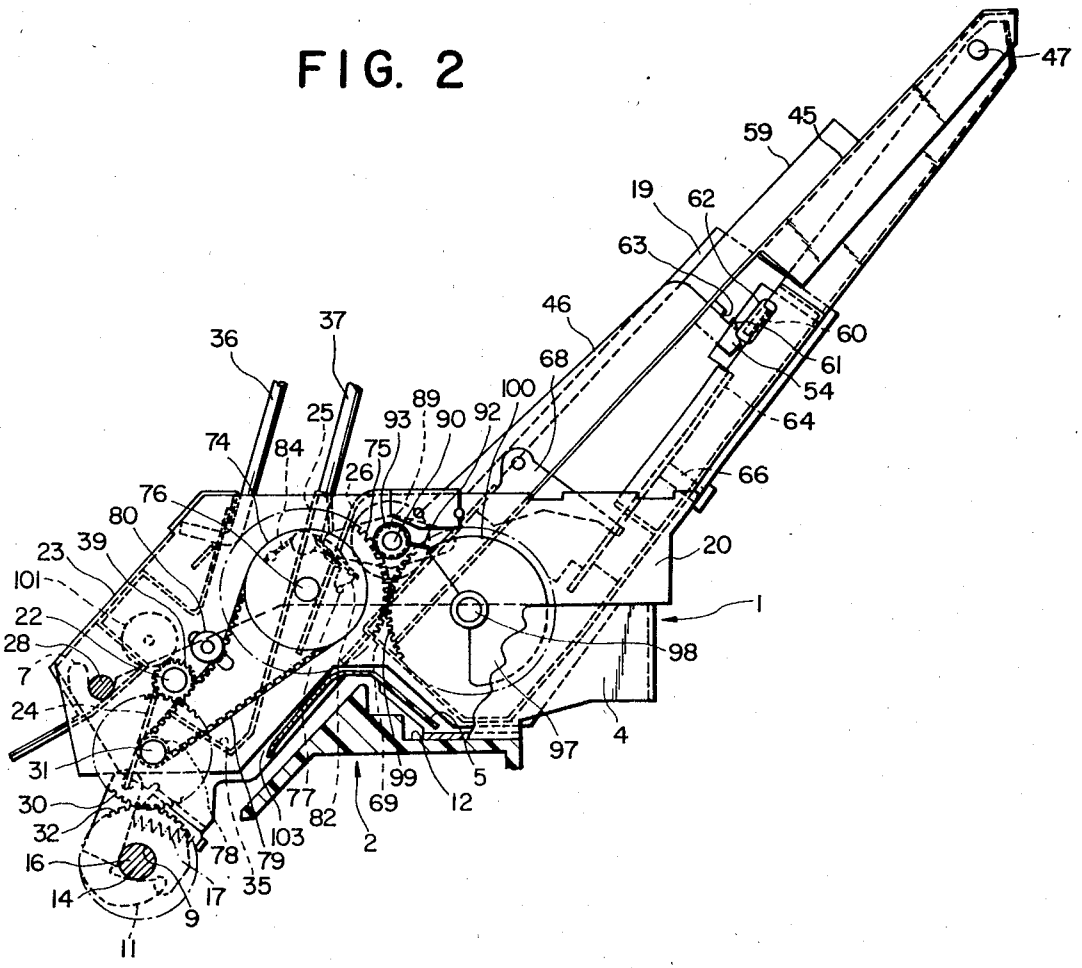
FIG. 2 is a right hand side elevational view, partly in section, of the automatic paper feeding device.
Figure 3:
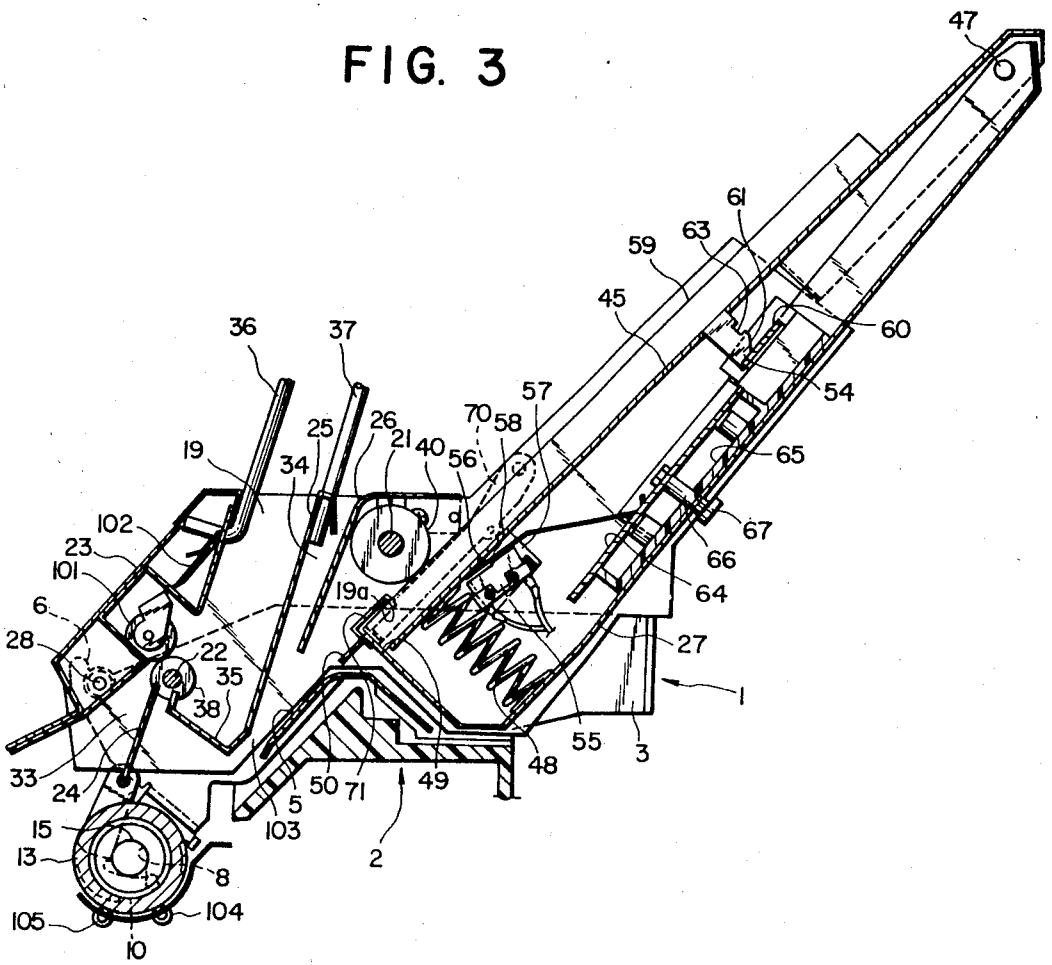
FIG. 3 is a vertical sectional view of the device.
Figure 4:
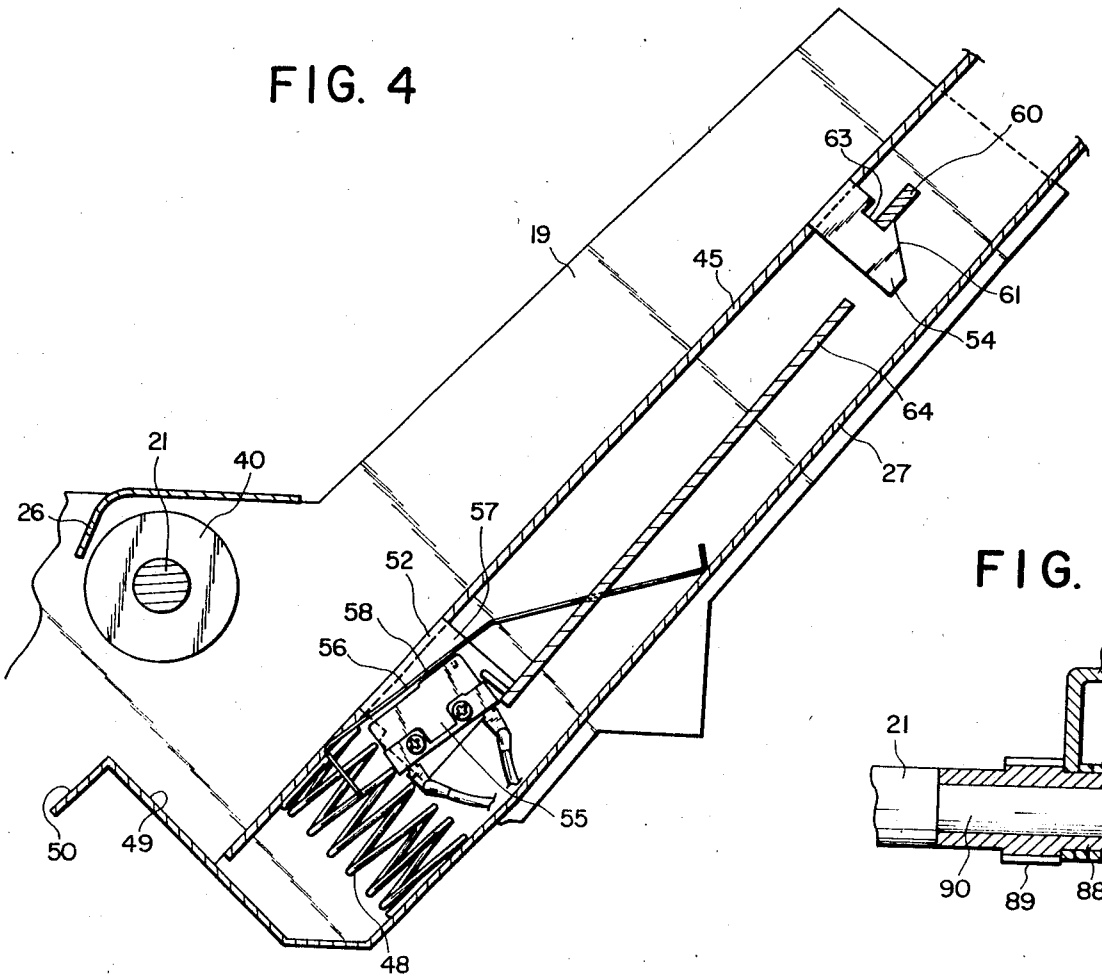
FIG. 4 is an enlarged partial cross sectional view of the device with a paper tray latched to an interrupting position.
Figure 5:
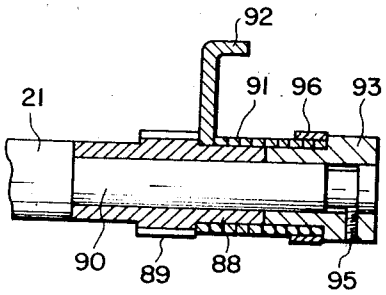
FIG. 5 is an enlarged sectional view showing a paper feed roller shaft and a clutch sleeve operatively connected to each other by means of a clutch spring.
Figure 6:
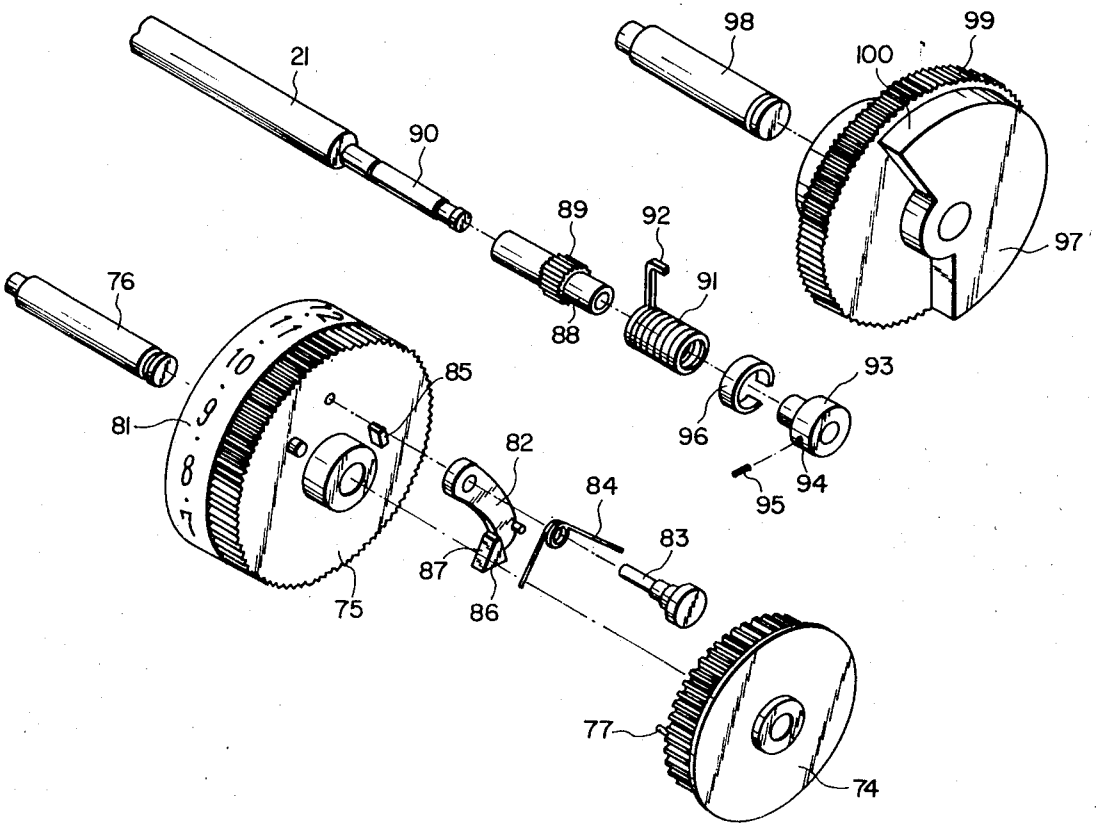
FIG. 6 is an enlarged fragmentary perspective view showing several parts of a transmission mechanism.

The paper tray 45 is in the form of a plate having a mountain-like configuration and has a middle upper end portion supported at a middle upper end of the support plate 27 by means of a shaft 47, so that it can be rocked about the shaft 47 between a forward position (an automatic paper feeding position as shown in FIGS. 2 and 3) and a rearward position (an interrupting position as shown in FIG. 4). The paper tray 45 is urged to rock to the forward position by means of a coil spring 48 provided between a rear side of a lower end portion of the paper tray 45 and the support plate 27.

The paper tray 45 has a left side edge engaged with an inner face of the left side wall 19 and a right side edge thereof spaced a little from the right side wall 20 while a lower edge is located just above a paper stopper 49 provided at a lower part of the support plate 27.

The paper stopper 49 is an integral part of the support plate 27 formed by bending a lower part of the support plate 27 and has a front edge 50 located just above the paper guide plate 5.

The paper tray 45 has center and left and right openings 51, 52 and 53 formed therein and has a hook 54 integrally formed to extend rearwardly from a left side edge of the center opening 51.

A sensing lever 56 of a microswitch 55 for detecting presence of paper is located in the opening 52 while the paper holder 46 is located in the opening 53.

The microswitch 55 is screwed to a mounting lug 57 which is formed in integral relationship with and extends rearwardly from a left side edge of the opening 52.

The sensing lever 56 has resiliency and is bent into a mountain-like form in side elevation. The sensing lever 56 is supported at a portion a little below the center thereof for back and forth rocking motion on the microswitch 55 and has a rear face of a lower portion abutted against a push botton 58 which is urged to project from the microswitch 55.

When the push button 58 is projected out to turn the microswitch 55 off, automatic paper feeding and printing operation are stopped. Thus, if sheets 59 of paper for printing are not loaded on the paper tray 45, the push button 58 is allowed to project out to rock the sensing lever 56 forwardly to a position in which a lower end portion thereof is projected from the opening 52.

On the contrary, when sheets 59 of paper are loaded on the paper tray 45, the sensing lever 56 is pushed at a lower end portion thereof and rocked rearwardly by the paper sheets 56 so that the lower end thereof is extended into the opening 52 while the push botton 58 is pushed in by the sensing lever 56 to turn the microswitch 55 on thereby to release the stopping of the automatic paper feeding and printing operation.

Meanwhile, if the paper tray 45 is latched to the rearward or interrupting position (FIG. 4) against the urging of the coil spring 48 in order to manually feed paper or to set paper in position, an upper end of the sensing lever 56 is abutted against the support plate 27 so that the sensing lever 56 is flexed a little. Accordingly, due to a spring force caused by such flexion of the sensing lever 56, the sensing lever 56 pushes in the push button 58 independently of presence or absence of paper 59 so that the microswitch 55 is held to its on position.

Due to this arrangement, when the paper tray 45 is latched to the interrupting position, even if the quantity of paper 59 is decreased so that a pressing force of paper 59 against the sensing lever 56 becomes smaller than the urging force of the push button 58, the lower end of the sensing lever 56 is not allowed to push up the paper 59 and extend forwardly from the opening 52 to thus turn the microswitch 55 off.

A lock lever 60 for latching the paper tray 45 to the interrupting position is supported for pivotal motion about one end thereof on the support plate 27 and is urged into engagement with a cam 61 of the hook 54 by a spring (not shown). A knob 62 is mounted at the other end of the lock lever 60 and extends outwardly in a rightward direction.

Thus, if the paper tray 45 is displaced to the interrupting position against the urging of the coil spring 48, the lock lever 60 is pushed by the cam 61 so that it once pivotally moves into engagement with a recess 63 of the hook 54 to thus latch the paper tray 45 to the interrupting position. In the meantime, if the lock lever 60 is pivoted upwardly to disengage from the recess 63, the paper tray 45 is released from the latching position.

The paper holder 46 is formed integrally with and extends upwardly from a right side edge of a rectangular base plate 64 and has an inverted L-shape configuration in side elevation. The base plate 64 is placed on a guide plate 65 made of a synthetic resin material and screwed to a front face of the support plate 27. A pair of guide pins 66 are screwed to left and right portions of the base plate 64 and are fitted slidably in elongated holes 67 formed in the guide plate 65 so as to support the base plate 64 for leftward and rightward movement. The paper holder 46 extends forwardly through the opening 53 of the paper tray 45 and has a forward edge of a lower portion which is located below the opening 53 and is fitted in the groove 42 of the collar 44 so as to link the paper holder 46 with the paper feed roller 41.

Sheets 59 of paper placed on the paper tray 45 are abutted at left side edges thereof with the left side wall 19 and are abutted at right side edges thereof with the paper holder 46 to hold the paper sheets 59 in position. In case the paper sheets 59 are of the A4 size, the paper holder 46 is located adjacent the right end of the opening 53 (FIG. 1), and in case of paper of the B5 size, the paper holder 46 is located adjacent the left end of the opening 53.

A retaining lever 68 is supported for pivotal motion about an upper portion thereof on a right side face of the paper holder 46 and has provided at a lower end thereof a retaining claw 69 for retaining a right lower corner portion of paper 59.

Another retaining lever 70 is supported for pivotal motion at an upper portion thereof on a left side face of the left side wall 19 and has provided at a lower end thereof a retaining claw 71 for retaining a left lower corner portion of paper 59. The retaining claw 71 is inserted inwardly through an opening **19*a* formed in the left side wall 19**.

The retaining levers 68 and 70 are urged to contact the retaining claws 69 and 71 thereof with paper 59 by means of springs (not shown), respectively.

Non-slip members 72 and 73 made of cork are applied to left and right portions on a front face of the paper tray 45 and prevent a plurality of paper sheets from being fed at once.

Thus, when paper sheets 59 are held in an automatic paper feeding position (FIG. 3), they are retained at left and right lower corner portions thereof by the retaining claws 71 and 69, and lower portions thereof are contacted with the paper feed rollers 40 and 41 while right edges are abutted with the paper holder 46.

A toothed pulley 74 and a relay gear wheel 75 are supported for individual rotation on a shaft 76 located on an outer side face of the right side plate 20 a little forwardly of the paper feed roller shaft 21.

The pulley 74 has a pin 77 mounted to project from a left side face thereof, and an annular toothed belt 79 extends between the pulley 74 and another toothed pulley 78 which is provided in integral relationship on a left side edge of the relay gear wheel 30.

A tension pulley 80 is contacted with an upper peripheral portion of the belt 79.

The relay gear wheel 75 has teeth formed along the entire periphery of a right hand side half of the thickness thereof while graduations 81 for indication of an automatic paper feeding cycle are provided along the entire periphery of the remaining left hand side half of the same.

Meanwhile, the relay gear wheel 75 has a clutch lever 82 for preventing reverse rotation mounted for rotation on a right side face thereof by means of a pin 82. The clutch lever 82 is urged into engagement with a projection 85 formed on the right right side face of the relay gear wheel 75 by means of a spring 84. Thus, the clutch lever 82 normally stands by at a fixed position (FIG. 2) in which it can be engaged with the pin 77 of the pulley 74.

When the pulley 74 is rotated forwardly (in the counterclockwise direction in FIG. 2) to engage the pin 77 with a connecting face 86 of the clutch lever 82, the relay gear wheel 75 is rotated forwardly in integral relationship with the pulley 74 while the clutch lever 82 is held at its fixed position.

On the contrary, when the pulley 74 is rotated reversely (in the clockwise direction in FIG. 2) to engage the pin 77 with a disconnecting face 87 of the clutch lever 82, the clutch lever 82 is pivoted in the counterclockwise direction (FIG. 2) against the urging of the spring 84 and is disengaged from the pin 77 so that the relay gear wheel 75 is not rotated thereby.

The graduations 81 are indicated at 15 equidistantly spaced positions around the entire circumference and have numerical indications from 0 to 14 assigned thereto. A point or dot is indicated between each two adjacent numerical indications.

A clutch sleeve 88 has an integral toothed gear wheel wheel 89 at a central portion thereof and is fitted for rotation around a reduced diameter portion 90 adjacent a right end of the paper feed roller shaft 21. A right end portion of the reduced diameter portion 90 extends outwardly in the rightward direction.

A coiled clutch spring 91 is wrapped around the clutch sleeve 88 such that it is closely fitted around an outer periphery of the latter. The clutch spring 91 has an L-shaped lug 92 integrally formed at a left end thereof.

A circular fixing tube 93 has a same diameter at a left side portion thereof with the clutch sleeve 88 and has a greater diameter at a right side portion thereof than the diameter at the left side portion. A threaded hole 94 is formed at the right side portion of the fixing tube 93.

A left side portion of the clutch spring 91 is fitted around the right side portion of the clutch sleeve 88 while a right side portion of the clutch spring 91 is fitted around the left side portion of the fixing tube 93 which is fitted on the right end portion of the reduced diameter portion 90 of the paper feed roller shaft 21. The fixing tube 93 is securely fixed to the reduced diameter portion 90 by means of a screw 95.

The clutch spring 91 is fastened, at the right side portion thereof fitted around the fixing tube 93, to the fixing tube 93 by means of a C-shaped fastening ring 96 fitted around an outer periphery of the right end portion of the fixing tube 93, and accordingly, the clutch spring 91 is integrally secured to the paper feed roller shaft 21 by way of the fixing tube 93.

Meanwhile, the left side portion of the clutch spring 91 is closely fitted around the clutch sleeve 88 so that when the lug 92 thereof is not in engagement with a control cam 97, it holds the clutch sleeve 88 tightly to establish connection thereof with the paper feed roller shaft 21.

The gear wheel 89 of the clutch sleeve 88 is in meshed engagement with the relay gear wheel 75.

Thus, rotation of the relay gear wheel 75 will integrally rotate the clutch sleeve 88 which in turn will integrally rotate the paper feed roller shaft 21 which is operatively connected thereto by means of the clutch spring 91.

The control cam 97 is supported for rotation on a shaft 98 located on an outer side face of the right side wall 20 rearwardly of the relay gear wheel 75. The control cam 97 has gear teeth 99 formed along the entire circumference of a left side half thereof while an arcuate or circumferential cam face 100 is formed along only about two thirds of the entire circumference of a right side half of the control cam 97.

The control cam 97 normally stands by at a fixed position (FIG. 2) in which the gear wheel 99 is meshed with the relay gear wheel 75 and an end of the arcuate cam face 100 thereof is engaged by the lug 92 of the clutch spring 91.

When the control cam 97 stands by at the fixed position as described just above, the clutch spring 91 with the lug 92 thereof engaged with the arcuate cam face 100 is loosened from the clutch sleeve 88 so that the paper feed roller shaft 21 is disconnected from the clutch sleeve 88.

If the control cam 97 is rotated (in the clockwise direction in FIG. 2) by rotation of the relay gear wheel 75, the arcuate cam face 100 is disengaged from the lug 92 of the clutch spring 91 so that the paper feed roller shaft 21 is connected to the clutch sleeve 88 by the clutch spring 91 and is integrally rotated thereby. Thus, after rotation of the control cam 97 over about one third of the entire circumference, the lug 92 of the clutch spring 91 is engaged again with the arcuate cam face 100 to thus disconnect the paper feed roller shaft 21 from the clutch sleeve 88 thereby stopping the paper feed roller shaft 21.

Three lower discharging rollers 101 are disposed at central and left and right locations in opposing relationship to the lower discharging rollers 38 and are each mounted for rotation at a lower end of a resilient support member 102 which has an upper end securely fixed to the partition plate 23. Thus, the lower discharging rollers 38 are contacted with upper peripheral portions of the lower discharging rollers 38, respectively.

Now, if if the platen 13 is rotated forwardly (in the clockwise direction in FIG. 2) by a motor (not shown) in order to discharge a sheet of paper after printing and automatically feed a new sheet of paper, the clutch sleeve 88, the paper feed roller shaft 21 and the control cam 97 are rotated in a predetermined direction by way of the platen gear wheel 32, the relay gear wheel 30, the gear wheel 39 and the relay gear wheel 75.

By the rotation of the gear wheel 39, the lower discharging rollers 38 are driven to rotate so that a paper sheet after printing is clamped between the upper and lower discharging rollers 101 and 38 and is thus carried into the storage section 35 via the discharging path 33.

In the meantime, by the rotation of the platen 13, the paper feed rollers 40 and 41 are rotated to deliver an uppermost one of sheets of paper 59 from the paper tray 45. The paper sheet 59 thus delivered is then guided by the paper guide plate 5 so that it is fed to the platen 13 via a feed-in path 103 provided between the guide plate 5 and the partition plate 25. After an end of the paper sheet 59 has been fed to a predetermined start position clamped between the platen 13 and paper pan rollers 104 and 105, the lug 92 of the clutch spring 91 is engaged with the arcuate cam face 100 of the control cam 97 so that the paper feed rollers 40 and 41 are stopped.

In this instance, with the new paper sheet 59 thus set to the start position, the graduations 81 of the relay gear wheel 75 are so positioned to bring the numerical indication of 0 to a reference mark provided on a casing (not shown).

Then, when the platen 13 continues its forward rotation to move the paper sheet 59 by a line space as printing operations proceed, the paper feed rollers 40 and 41 are rotated in a predetermined direction by the movement of the paper sheet 59 due to operation of the one-way clutch, thus eliminating an unnecessary load to the movement of the paper sheet 59.

Meanwhile, as the paper sheet 59 moves by line spacing operations, the relay gear wheel 75 is rotated in a predetermined direction to successively bring numerical indications for the graduations 81 corresponding to printed lines to the reference mark to thus indicate a paper feeding cycle. Moreover, by an amount of rotation of the platen 13 corresponding to a cycle until required printing is completed after a paper sheet after printing has been discharged into the storage section 35 and then a new paper sheet 59 has been fed to the platen 13, the relay gear wheel 75 and the control cam 97 are rotated one complete rotation.

In the instance described just above, even if the platen 13 is rotated reversely in order to effect correction or superscription during a printing operation, the relationship of the control cam 97 and the graduations 81 with a paper feeding cycle is still maintained since the relay gear wheel 75 and the control cam 97 are held stopped due to operation of the clutch lever 82.

As apparent from the foregoing description, according to the present invention, a paper feed roller is rotated via a clutch by a platen which is driven to rotate by a motor, and after a predetermined paper feeding operation, the clutch is controlled to stop rotation of the paper feed roller. Accordingly, there is no necessity of provision of a motor exclusively for a paper feed roller, resulting in reduction of the production cost corresponding thereto. In addition, there is no necessity of provision of a motor exclusively for a paper feed roller and a motor for a platen, eliminating the necessity of difficult control to operate the two motors in harmonized relationship and thus preventing possible troubles caused by incomplete harmonization of the motors, reducing the need for maintenance and repair of a paper feeding device.

What is claimed is:

1. A device for automatically feeding a print medium from a supply station to a receiving station via a rotatable feeding element of a printer or typewriter, comprising: a driving element operable to rotate in synchronism with said feeding element; a first feed member for feeding a print medium from said supply station to said feeding element; a second feed member driven by said driving element to feed a print medium fed from said feeding element to said receiving station; and means for intermittently transmitting rotation of said driving element to said first feed member to allow a print medium to be fed from said supply station to said feeding element by said first feed member after another print medium has been discharged from said feeding element and fed to said receiving station by said second feed member, said means including a clutch sleeve connected to be driven by said driving element, a clutch spring partially wrapped around said clutch sleeve and having one end connected to said first feed member, and a controlling cam connected to be driven by said driving element for controlling said clutch spring between a first position in which said first feed member is connected to be driven by said clutch sleeve and a second position in which said first feed member is disconnected from said clutch sleeve, said cam having a circumferential cam face positioned for engagement with an outer extension of the other end of said clutch spring to hold said clutch spring to said second position over a part of a complete rotation of said controlling cam, said spring clutch being held to said first position when said outer extension thereof is free from said circumferential cam face of said controlling cam over the other part of a complete rotation of said controlling cam.

2. A device as claimed in claim 1, wherein said controlling cam is directly driven by said clutch sleeve.

3. A device for automatically feeding a print medium from a supply station to a receiving station via a rotatable feeding element of a printer or typewriter, comprising:

a driving element operable to rotate in synchronism with said feeding element;

a first feed member for feeding a print medium from said supply station to said feeding element;

a second feed member driven by said driving element to feed a print medium fed from said feeding element to said receiving station; and means for intermittently transmitting rotation of said driving element to said first feed member to allow a print medium to be fed from said supply station to said feeding element by said first feed member after another print medium has been discharged from said feeding element and fed to said receiving station by said second feed member, said means for intermittently transmitting a rotation including a clutch sleeve connected to be driven by said driving element, a clutch spring partially wrapped around said clutch sleeve and having one end connected to said first feed member, and a controlling cam connected to be driven by said driving element for controlling said clutch spring between a first position in which said first feed member is connected to be driven by said clutch sleeve and a second position in which said first feed member is disconnected from said clutch sleeve, said mechanism for intermittently transmitting rotation also including a transmission mechanism which provides a greater circumferential speed of said first feed member for feeding a print medium than that of said second feed member to allow a print medium to be fed from said supply station to said feeding element within a relatively small part of a cycle of print medium feeding operation established by one complete rotation of said controlling cam.

4. A device for automatically feeding a print medium from a supply station to a receiving station via a rotatable feeding element of a printer or typewriter, comprising: a first feed shaft having a feed roller thereon for feeding a print medium from said supply station to said feeding element; a second feed shaft having a feed roller thereon for feeding a print medium from said feeding element to said receiving station; means for coupling said second feed shaft to said feeding element; a clutch sleeve mounted for rotation on and relative to said first feed shaft; transmission means for coupling said first feed shaft to said clutch sleeve; a clutch spring having one end secured to said first feed shaft and the other end extending outwardly therefrom, said clutch spring in its free position being tightly wrapped around said clutch sleeve to transmit rotation of said clutch sleeve to said first feed shaft; a first gear wheel secured to said clutch sleeve; a second gear wheel meshed with said first gear wheel and having a larger diameter than said first gear wheel; and a controlling cam secured to said second gear wheel and having a circumferential cam face extending over a part of a given circumference thereof, said cam face being positioned for engagement with said the other end of said spring clutch to loosen said spring clutch to disconnect said first feed shaft from said clutch sleeve.

5. A device as claimed in claim 4, wherein said device is removably mounted on said printer, and said means for coupling includes a gear wheel which is engaged with another gear wheel secured to said feeding element when said device is mounted in position on said printer.

6. A device as claimed in claim 4, wherein said cam face of said controlling cam extends over more than one half of said given circumference.

7. A device as claimed in claim 4, wherein said transmission means includes a third gear wheel meshed with said first gear wheel and having an adjacent integral cylindrical portion which has indications of rotational angular positions of said third gear wheel applied to an outer periphery thereof in order to indicate a position of a print medium relative to said feeding element.

8. A device as claimed in claim 4, wherein said transmission means includes means for preventing rotation of said first feed shaft in a reverse direction to feed a print medium from said feeding element toward said supply station.

* * * * *